US005847648A

United States Patent [19]

Savor et al.

[11] Patent Number: 5,847,648

[45] Date of Patent: Dec. 8, 1998

[54] ALARM AND INTERMITTENT ALERT SYSTEM FOR VEHICLE OPERATION

[75] Inventors: Douglas R. Savor, 1703 N. Chestnut St., Suite 108, Marshfield, Wis. 54449; Michael J. Rose, Harvard, Ill.

[73] Assignee: Douglas R. Savor, Marshfield, Wis.

[21] Appl. No.: 753,352

[22] Filed: Nov. 25, 1996

Related U.S. Application Data

[63] Continuation of Ser. No. 194,413, Feb. 10, 1994, abandoned.

[51] Int. Cl.[6] ..... G08B 1/00

[52] U.S. Cl. ..... 340/309.15; 340/328; 340/329; 340/576

[58] Field of Search ..... 340/309.15, 328, 340/329, 576; 368/5, 6, 10, 12, 72

[56] References Cited

U.S. PATENT DOCUMENTS

| | | | |
|---|---|---|---|
| 4,258,354 | 3/1981 | Carmon et al. | 340/309.4 |
| 4,415,273 | 11/1983 | Hoffman et al. | 368/74 |
| 4,459,037 | 7/1984 | Toyoda | 368/255 |
| 4,504,062 | 3/1985 | Smith, III et al. | 273/313 |
| 4,523,856 | 6/1985 | Gygax | 368/72 |
| 4,545,686 | 10/1985 | Ushikoshi | 368/63 |
| 4,905,526 | 3/1990 | Magnussen et al. | 73/864.18 |
| 4,999,821 | 3/1991 | Kirkland | 368/12 |
| 5,089,998 | 2/1992 | Rund | 368/72 |

FOREIGN PATENT DOCUMENTS

| | | | |
|---|---|---|---|
| 2012076 | 1/1978 | United Kingdom | G04C 23/08 |

OTHER PUBLICATIONS

Encylopedia of Electronic Circuits, vol. 5, Rudolf R. Graf & William Sheets.

*Primary Examiner*—Jeffery A. Hofsass
*Assistant Examiner*—Julie B. Lieu
*Attorney, Agent, or Firm*—Whyte Hirschboeck Dudek SC

[57] ABSTRACT

A standard digital display alarm clock is provided which is driven by a 1.5 volt DC power source. A two-tone alarm device, whose sound level is adjustable from 60 dB to 100 dB, is electrically wired to the clock and sounds when the clock attains a predetermined time. The power for the alarm device is supplied by either a 9 volt DC source contained within the clock or a 12 volt DC automotive cigarette lighter. The clock is provided with an intermittent alert feature which will cause the alarm to sound every four minutes for an indefinite amount of time and requires operator input to deactivate.

13 Claims, 4 Drawing Sheets

ALARM AND INTERMITTENT ALERT SYSTEM FOR VEHICLE OPERATION

"This is a continuation of application Ser. No. 08/194,413 filed on Feb. 10, 1994, now abandoned."

CROSS-REFERENCE TO RELATED APPLICATIONS

If Any: None.

Statement As To Rights To Inventions Made Under Federally Sponsored Research and Development If Any: None.

FIELD OF THE INVENTION

The present invention relates generally to digital alarm clocks, and specifically to a low-voltage, digital alarm clock which operates in conjunction with a high frequency, variable sounding device operating at a higher voltage, wherein the device can be used either as an alarm clock to waken sleeping users or an intermittently sounding alert system to keep drivers awake during vehicle operation.

BACKGROUND OF THE INVENTION

Vehicle operators, such as diesel truck drivers, who are required to drive long distances with very little sleep often find it useful to have a means for keeping them alert during times when they are subject to drowsiness. Typically, a truck driver can resort to an alarm clock as a means to combat drowsiness. However, for such a device to be effective, it must operate to constantly alert the driver. Mechanical alarm clocks are not typically designed with intermittent systems for sounding alarms because a mechanical clock must be reset each time its alarm is turned off. Digital alarm clocks typically have an intermittent "snooze" feature which allows the operator to turn off the alarm for a short period of time, usually between two and ten minutes, before sounding again. This snooze feature continues for an hour and then automatically terminates. Although both kinds of alarm clocks are useful as a method of waking someone who is already sleeping, they were not intended to be used over extended periods of time to keep someone awake.

The prior art is replete with conventional alarm clocks. Typical features of digital alarm clocks in the field appear in U.S. Pat. No. 4,415,273 issued to Hoffman et al. A large digital display is used to indicate the time. A piezoelectric buzzer can be actuated by the clock to give off an audible sound. The clock is provided with a sensor button used to initiate a snooze cycle once the alarm is activated. The snooze interval is ten minutes and can be repeated a total of five times by depressing the sensor button.

Additionally, the interior noise level within the cabs of diesel trucks will often prevent the truck driver from hearing a conventional device such as an alarm on an alarm clock. The decibel level generated by the truck's diesel engine and the cab's air conditioner, as well as additional devices such as the refrigeration units of refrigerated trailers, is often greater than the decibel level of conventional alarm clocks. Typically, the sound intensity in diesel cabs is at least 50 dB if not greater. Furthermore, many truck drivers become so accustomed to the elevated noise within the cab while driving that they do not respond to low levels of noise that can be created by conventional devices. This same problem is true for devices used within the sleeping units of cabs. Because a truck driver may become so accustomed to a sleeping environment characterized by an elevated noise level, such as 50 dB, the noise level of a conventional alarm, which is much less than 50 dB, would be ineffective in waking the driver from sleep.

U.S. Pat. No. 4,999,821 issued to Kirkland addresses this problem in part. Described is a conventional mechanical alarm clock constructed from metal parts, including a metal base and a metal alarm tip, which are in electrically conductive contact. A piezoelectric buzzer capable of producing a sound pressure level of 100 dB is attached to the metal base by a grounded lead wire. A power lead wire runs from the buzzer to the positive output of standard 12 volt automotive cigarette lighter adapter. A grounded lead wire runs from the adapter to an insulated terminal attached to the metal base of the clock. When the internal alarm system in the clock is actuated, the alarm tip moves into contact with the insulated terminal, completing the grounded side of the circuit and causing the buzzer to sound. This device has been found to be advantageous in waking sleeping truck drivers. The 100 dB buzzer described produces a sound which is louder than the typical background noise of most sleeper compartments on diesel trucks. However, the use of the metal casing as a means of completing the circuit for the buzzer can result in unpredictable results because of undesirable electrical connections. Additionally, this type of mechanical alarm clock does not permit use as an intermittent alert device. Finally, this device is constrained to use with a 12 volt automotive cigarette lighter.

It is therefore desirable to provide a portable clock which can be used as either an intermittent alert for drivers who are operating their vehicles or an alarm to wake drivers who are sleeping in the loud environment of diesel cab sleepers.

SUMMARY OF THE INVENTION

Generally speaking, and in accordance with the invention, a standard digital clock display is provided which is driven by a 1.5 volt DC power source. A two-tone alarm device, whose sound level is adjustable from 60 dB to 100 dB, is electrically wired to the clock and sounds when the clock attains a predetermined time. The power for the alarm device is supplied by either a 9 volt DC source contained within the clock or a 12 volt DC automotive cigarette lighter. The clock is provided with an intermittent alert feature which will cause the alarm to sound every four minutes for an indefinite amount of time and requires operator input to silence.

Accordingly, it is an object of this invention to provide an improved low power, digital, portable alarm clock having a high decibel alarm device.

Another object of the invention is to provide a portable intermittent alert system having a high decibel alarm device.

DETAILED DESCRIPTION OF THE PREFERRED EMBODIMENT

Figure 1:
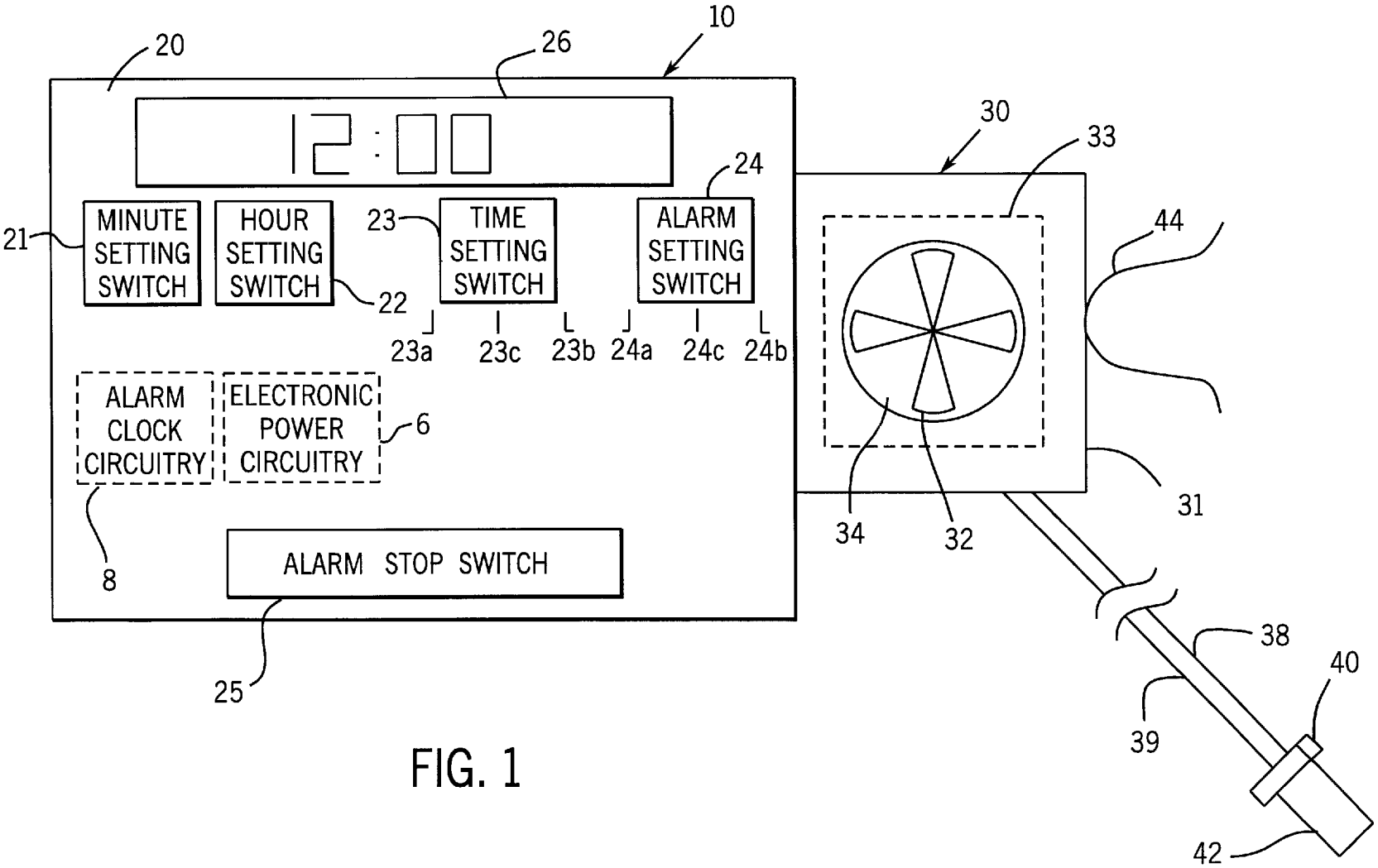
FIG. 1 is a front view of the 9 volt embodiment of the alarm clock of the present invention.

Referring to the drawings of FIG. 1, an intermittent alert and alarm clock device 10 designates one complete assembly of the invention. The invention comprises a clock housing 20, formed from rigid plastic, such as ABS resin. Disposed on housing 20 are push button minute setting (or count-up) switch 21, push button hour setting (or count-up) switch 22, and push button alarm stop switch 25. Push button alarm stop switch 25 also serves as a light switch. Also disposed on housing 20 are a 3-position slide time setting switch 23 having a stop position 23*a* for setting the clock, a stop position 23*b* for setting the alarm and a stop position 23*c* for locking all time setting modes, and a 3-position slide alarm mode switch 24 having a stop position 24*a* for arming the intermittent alert mode, a stop position 24*b* for arming the alarm mode and a stop position 24*c* for disarming all modes. Set in the face of housing 20 is liquid crystal display (LCD) 26 having appropriate alphanumeric displays indicating the current time and whether the alarm is armed. Closure of switch 25 activates a light (not shown) which illuminates LCD 26 thus permitting viewing in environments with little or no lighting. The clock itself is a standard digital alarm clock. The model utilized in the invention is sold by General Time Corporation, Inc. Attached to housing 20 is an alarm mechanism generally designated as alarm mechanism 30. Alarm mechanism 30 comprises a housing 31, formed from rigid plastic, such as ABS resin, wherein housing 31 has an opening 32 for emitting the sound generated by alarm mechanism 30. Rotatably attached adjacent opening 32 is shutter 34 which can be adjusted to regulate the size of opening 32. Encased within housing 31 is a standard piezoelectric buzzer 33 which is simply constructed and can produce a loud sound with comparatively low power consumption. The specifics of piezoelectric buzzer 33 will not be further described except for the operating parameters required by the invention. Leads 38, 39 run between the alarm mechanism 30 and battery connector 40 disposed for receiving the electrical contacts (not shown) of a standard 9 volt battery 42. Battery holder 44 secures battery 42 and is attached to housing 20 adjacent alarm mechanism 30.

Clock housing 20 can be split in a conventional manner to allow disassembly and reassembly of the housing to provide access to the interior of the clock housing. Disposed in clock housing 20 is the electronic power circuity 6 (schematically illustrated in FIG. 3) of the present invention, as well as digital alarm clock circuitry 8 found in conventional digital alarm clock modules. The digital alarm clock circuitry 8 functions as timing circuit and generates an output signal which is received by the electronic power circuitry 6 of the present invention. The digital alarm clock circuitry 8 is not an aspect of the present invention and is not further described herein. The purpose of electronic power circuitry 6 is to ensure that no current backflow reaches alarm clock circuitry 8.

Figure 2:
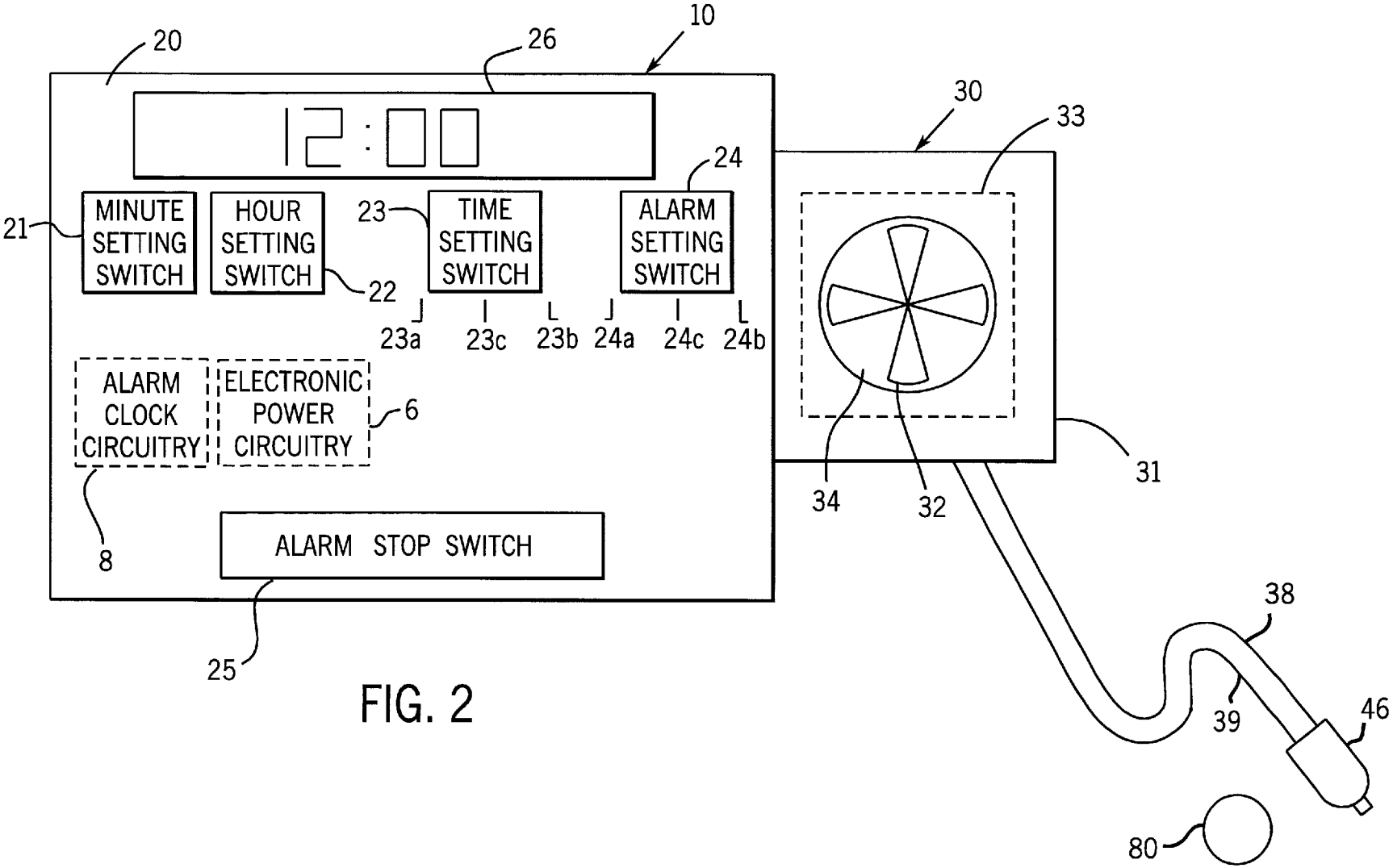
FIG. 2 is a front view of the 12 volt embodiment of the alarm clock of the present invention.

FIG. 2. shows another embodiment of the invention. Replacing battery connector 40 and 9 volt battery 42 at the end of leads 38, 39 is a standard 12 volt automotive cigarette lighter adapter 46 which is adapted to be inserted into a standard cigarette lighter socket 80 on a standard automotive vehicle so as to connect with a 12 volt battery of the automobile. The cigarette lighter is provided with the necessary connections (not shown) for connecting with the output voltage in the standard socket (not shown) referred to above. The cigarette lighter adaptor 46 provides a 12 volt DC source of power for alarm mechanism 30 through leads 38, 39. Electronic power circuity 6 can be adapted to operate with a 12 volt power source for alarm mechanism 30. Of course, battery holder 44 is not required when the 12 volt embodiment of the invention is practiced.

Figure 3:
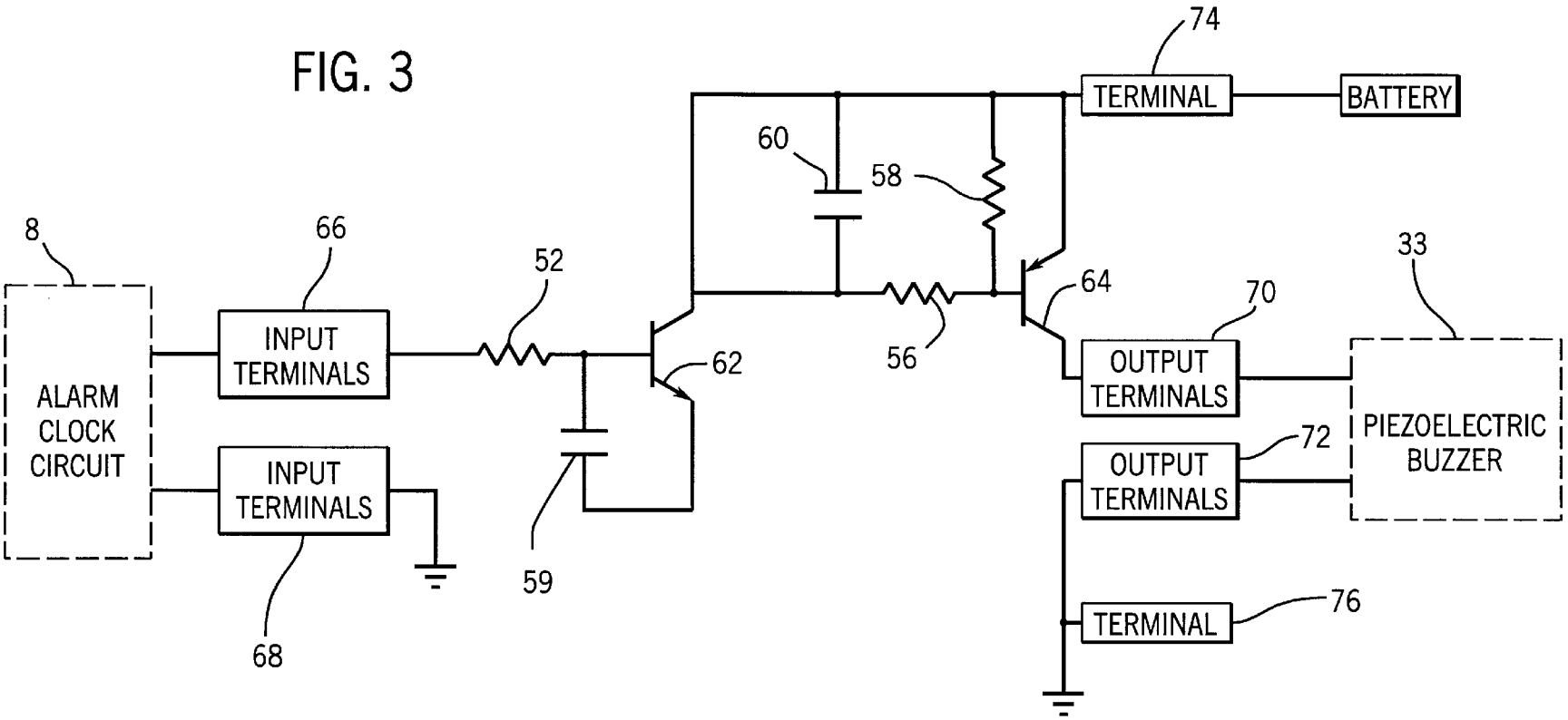
FIG. 3 is a schematic diagram of the circuity used for the 9 volt embodiment of the invention to prevent power for the alarm mechanism from interfering with the clock mechanism.

Turning to FIG. 3, electronic power circuitry 6 (FIG. 1) of the present 9 volt embodiment of the invention is schematically illustrated. With the exception of the piezoelectric buzzer 33, 9 volt battery 42 and alarm clock circuitry 8, all the elements shown in FIG. 3 are mounted on a printed circuit board which is mounted into the interior of housing 20.

The electronic power circuitry 6 comprises signal input terminals 66, 68, power output terminals 70, 72, power input terminals 74, 76, transistors 62, 64, capacitors 59, 60, and resistors 52, 56 and 58. The arrangement depicts a two-stage transistor amplifier in which resistor 52 is used to limit the input current to the base of transistor 62 and resistors 56, 58 are used to limit the input current to the base of transistor 64.

Power from 9 volt battery 42 is received across terminals 74, 76 from leads 38, 39. Output signals generated by electronic clock circuitry 8 are received across terminals 66, 68. Power output terminals 70, 72 are connected to the piezoelectric buzzer 33. When a signal is received across terminals 66, 68, capacitor 59 discharges, generating a signal which is received by the base of transistor 62, causing transistor 62 to activate. When transistor 62 activates it produces a signal which is received by capacitor 60. The 9 volt power signal received across terminals 74, 76 will be transmitted to power output terminals 70, 72 and activate piezoelectric buzzer 33 when capacitor 60 discharges in response to output from transistor 62. This arrangement prevents power from the 9 volt input across power input terminals 74, 76 from backflowing through terminals 66, 68 and damaging alarm clock circuit 8.

Alarm clock circuit 8 performs in the conventional manner. Its power is received from two 1.5 volt batteries (not shown). The clock time can be set by adjusting switch 23 to stop position 23*a* and simultaneous closure of switches 21 or 22. Similarly, the alarm time can be preselected by adjusting switch 23 to stop position 23*b* and simultaneous closure of switches 21 or 22. Once the clock time and the alarm time are set, switch 23 can be moved to position 23*c* to prevent accidently altering either the clock time or the alarm time. The intermittent alert mode of the device can be activated by moving switch 24 to position 24*a*. The alarm mode of the device can be activated by moving switch 24 to position 24*b*. If neither the intermittent alert or alarm modes are desired, moving switch 24 to position 24*c* disarms both modes.

If the intermittent alert mode of the invention is armed, alarm clock circuit 8 will generate a signal across input terminals 66, 68 when a preselected time is attained. This will cause the electronic power circuitry 6 to direct the power across input terminal 74 76 to power output terminal 70, 72, which, in turn, will activate piezoelectric buzzer 33 of alarm device 30. Alarm device 30 will produce two-tone, intensity-variable signal of at least 50 dB. In the preferred embodiment, alarm device 30 can produce a 100 dB signal. This signal is much louder than other sounds which are typically present in the cab of diesel trucks, thus permitting one to clearly hear the alarm when it activates. The intensity of the signal can be varied from 60 dB to 100 dB by altering the position of rotatable shutter 34 over opening 32. Fully closed, the device will produce a signal of approximately 60 dB; fully opened, the device will produce a signal of approximately 100 dB. If the device is in intermittent alert mode, closure of switch 25 will re-set alarm clock circuitry 8 to again generate a signal across input terminals 66, 68 after four minutes have elapsed. This intermittent alert process can continue in four minute intervals for as long as the user desires.

When the alarm mode is armed, alarm clock circuitry 8 will also generate a signal across terminals 66, 68 when a preselected time is attained. In this case, however, closure of switch 25 will deactivate the alarm mode, resulting in termination of power to piezoelectric buzzer 33 of alarm mechanism 30.

The circuitry shown in FIG. 3 will prevent the power for the piezoelectric buzzer 30 from interfering with the alarm clock circuitry 8 by backflowing across input terminals 66, 68. The circuitry of the present invention is necessary because the components of the invention, namely piezoelectric buzzer 33 and alarm clock circuitry 8, require different amounts of power to operate properly. As mentioned above, alarm clock circuitry 8 is powered by two 1.5 volt batteries, while the piezoelectric buzzer 33 is powered by a 9 volt battery. Alarm clock circuitry 8 may malfunction if the power required for the piezoelectric buzzer 33 is fed into the alarm clock circuitry 8. In this embodiment, the power source for both alarm clock circuitry 8 and piezoelectric buzzer 33 is self-contained, permitting mobility.

Figure 4:
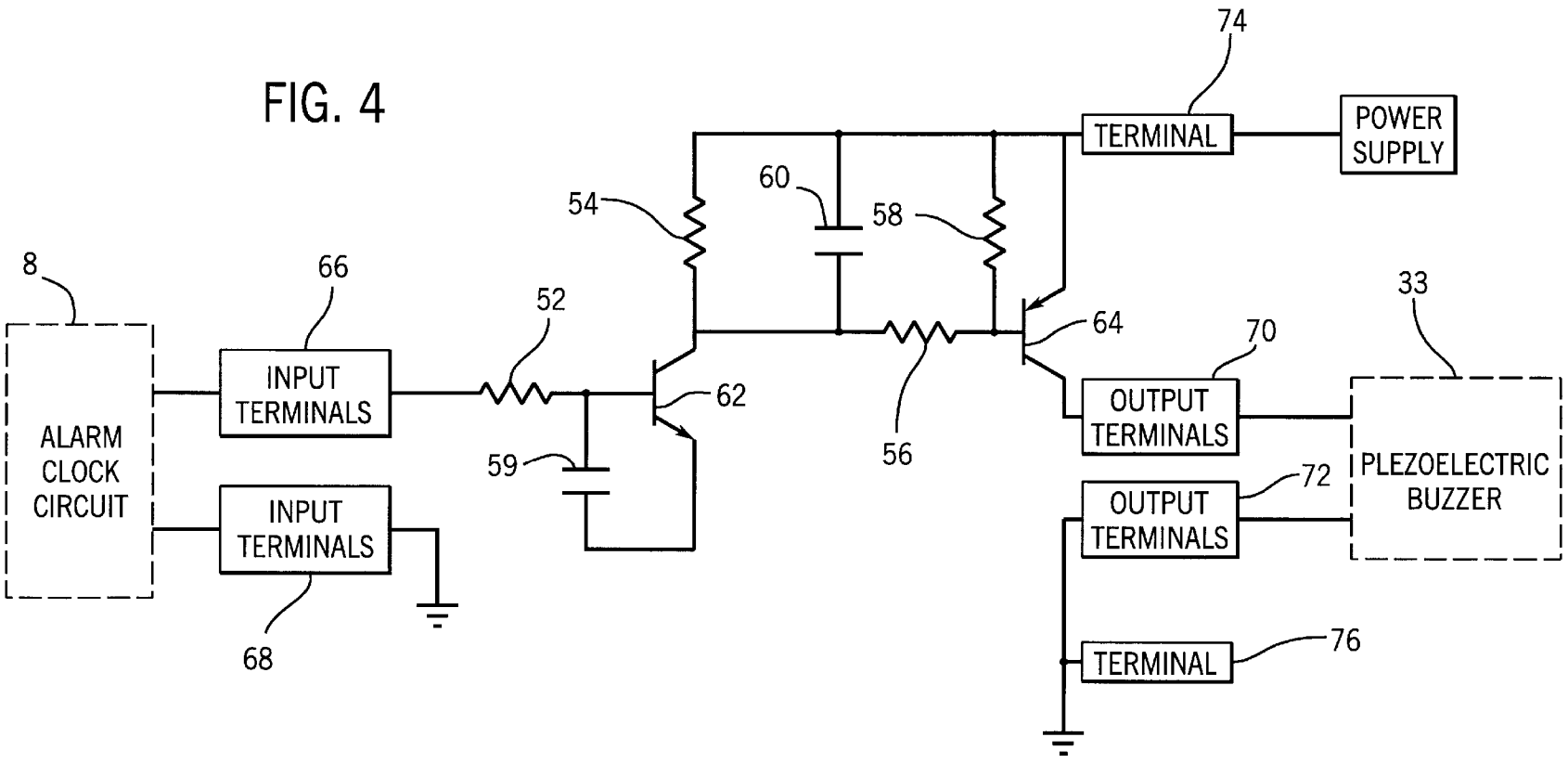
FIG. 4 is a schematic diagram of the circuity used for the 12 volt embodiment of the invention to prevent power for the alarm mechanism from interfering with the clock mechanism.

FIG. 4 illustrates the electronic power circuity 6 (FIG. 2) required for the 12 volt embodiment of the invention. In this embodiment, an additional resistor 54 is added to the 9 volt electronic power circuitry of FIG. 3. The 12 volt electronic power circuitry operates in the same way as the 9 volt circuitry. Again, the purpose of the 12 volt circuitry is to prevent the power for the alarm mechanism from interfering with the clock circuitry.

In yet another embodiment of the invention, a digital alarm clock having a light emitting diode (LED) display replaces the LCD type digital alarm clock. The LED display permits viewing in environments with little or no light, thus replacing the lighting function of switch 25.

Although the above device is described for use by truck drivers and others operating motor vehicles, the device may be used equally well in any environment characterized by high sound levels. Additionally, the device is suitable for use by hearing impaired individuals.

An intermittent alert and alarm clock for use by truck drivers is described above. It will be understood that various other changes of the details, materials, steps, arrangements of parts, and uses, which have been herein described and illustrated in order to explain the nature of the invention, will occur to and may be made by those skilled in the art, upon reading this disclosure, and such changes are intended to be included within the principles and scope of this invention.

What is claimed is:

1. An alert and alarm clock capable of functioning as an alarm clock and an intermittent alert device comprising:

a switch operable to place the clock in two different modes of operation;

a digital display alarm clock that generates an alarm signal at preselected times during the two different modes of operation, the preselected times of the alarm signal providing capability for the alert and alarm clock to function in one mode of operation as an alarm clock generating the alarm signal at a preselected set time after a wait period, and in a second mode of operation as an intermittent alert device continuously generating the alarm signal only at predefined intervals free of a preselected set time and wait period to provide constant alert function;

a high output buzzer electrically connected to said alarm clock and activated by the alarm signal; and an isolation circuit connected between the alarm clock and the buzzer for preventing feedback to the alarm clock, the isolation circuit receiving the alarm signal from the alarm clock and activating the buzzer in response.

2. The clock of claim 1 wherein the isolation circuit comprises a pair of switching transistors, a first switching transistor receiving the alarm signal and thereby activating a second switching transistor to provide a power source to the buzzer.

3. The clock of claim 2 wherein the power source is provided to the buzzer by the second switching transistor as long as the alarm signal is provided to the first switching transistor by the alarm clock.

4. The clock of claim 1 wherein the digital display alarm clock is driven by a low voltage source having a voltage potential of at least 1.5 volts, and the high output buzzer is driven by a high voltage source having a voltage potential of at least 9 volts.

5. The clock of claim 2 wherein the first switching transistor is an npn transistor and the second switching transistor is a pnp transistor.

6. The clock of claim 1 wherein the buzzer is a piezoelectric device.

7. The clock of claim 6 wherein the buzzer produces at least a 50 dB sound signal as a result of available high voltage from the high voltage source.

8. An alert and alarm clock comprising:

a digital display alarm clock that generates an alarm signal at preselected times, the digital display alarm clock operable at a first voltage, the preselected times of the alarm signal providing capability for the alert and alarm clock to function in at least two operating modes, a first operating mode operable as an alarm clock generating the alarm signal at a preselected time, and a second operating mode operable as an intermittent alert device generating the alarm signal periodically at predefined intervals without a preselected time to provide a constant alert function;

a switch in operable association with the digital display alarm clock having a position for each operating mode;

a high output alarm electrically connected to said alarm clock and activated by the alarm signal, the high output alarm operable at a second voltage higher than the first voltage of the digital display alarm clock; and an isolation circuit connected between the alarm clock and the alarm for preventing feedback to the alarm clock, the isolation circuit receiving the alarm signal from the alarm clock and activating the alarm in response, the isolation circuit comprising a pair of switching transistors, a first switching transistor receiving the alarm signal and thereby activating a second switching transistor to provide a power source to the alarm.

9. The clock of claim 8 wherein the power source is provided to the high output alarm by the second switching transistor as long as the alarm signal is provided to the first switching transistor by the alarm clock.

10. The clock of claim 8 wherein the first voltage has a potential of at least 1.5 volts, and the second voltage has a potential of at least 9 volts.

11. The clock of claim 8 wherein the first switching transistor is an npn transistor and the second switching transistor is pnp transistor.

12. The clock of claim 8 wherein the high output alarm is a piezoelectric device.

13. The clock of claim 8 wherein the high output alarm produces at least a 50 dB sound signal as a result of the second voltage.

* * * * *